US009667001B2

(12) United States Patent
Zhao et al.

(10) Patent No.: US 9,667,001 B2
(45) Date of Patent: May 30, 2017

(54) RECEPTACLE CONNECTOR HAVING IMPROVED INSULATIVE HOUSING

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/088,155

(22) Filed: Apr. 1, 2016

(65) Prior Publication Data

US 2016/0294102 A1 Oct. 6, 2016

(30) Foreign Application Priority Data

Apr. 2, 2015 (CN) ..... 2015 1 0153882

(51) Int. Cl.

| | |
|---|---|
| ***H01R 24/60*** | (2011.01) |
| ***H01R 13/6581*** | (2011.01) |
| ***H01R 13/6585*** | (2011.01) |
| *H01R 12/72* | (2011.01) |

(52) U.S. Cl.

CPC ..... *H01R 24/60* (2013.01); *H01R 13/6581* (2013.01); *H01R 13/6585* (2013.01); *H01R 12/724* (2013.01)

(58) Field of Classification Search

USPC .... 439/607.27, 607.05, 55, 357, 607.55, 78, 439/607.32

See application file for complete search history.

(56) References Cited

U.S. PATENT DOCUMENTS 5,073,130 A * 12/1991 Nakamura ..... H01R 13/65802 439/607.32
8,475,216 B2 * 7/2013 Tung ..... H01R 13/506 439/607.4
8,851,927 B2 * 10/2014 Hsu ..... H01R 12/724 439/607.11

(Continued)

FOREIGN PATENT DOCUMENTS

CN 203871583 10/2014
CN 204289826 4/2015

*Primary Examiner* — Alexander Gilman

(74) *Attorney, Agent, or Firm* — Wei Te Chung; Ming Chieh Chang

(57) ABSTRACT

A receptacle connector includes a first housing, a second housing, a number of first contacts and second contacts, a metallic plate sandwiched between the first housing and the second housing, and a shielding shell. The first housing has a first base and a first tongue portion. The first tongue portion has a connection portion close to the first base and a first stepping portion in a lower surface. The second housing has a second tongue portion. The second tongue portion has a second stepping portion in an upper surface. Each first contact has a first affixed portion. The metallic plate has a connecting section inclining with the connection portion and the first affixed portion in a same direction and an opening receiving the first stepping portion and the second stepping portion. The first stepping portion and the second stepping portion contacts with each other through the opening.

14 Claims, 10 Drawing Sheets

(56) References Cited

U.S. PATENT DOCUMENTS

| | | | | |
|---|---|---|---|---|
| 9,022,800 | B2 * | 5/2015 | Yang | H01R 13/6581 439/487 |
| 9,466,930 | B2 * | 10/2016 | Little | H01R 24/60 |
| 9,496,664 | B2 * | 11/2016 | Little | H01R 13/6587 |
| 9,525,227 | B2 * | 12/2016 | Little | H01R 13/6273 |
| 2010/0267261 | A1 * | 10/2010 | Lin | H01R 13/6461 439/218 |
| 2014/0024257 | A1 * | 1/2014 | Castillo | H01R 13/6585 439/607.05 |
| 2015/0044886 | A1 * | 2/2015 | Little | H01R 12/75 439/55 |
| 2015/0056839 | A1 * | 2/2015 | Zhang | H01R 12/724 439/350 |
| 2015/0072562 | A1 * | 3/2015 | Little | H01R 13/6658 439/607.55 |
| 2015/0194772 | A1 * | 7/2015 | Little | H01R 13/6597 439/357 |
| 2015/0340813 | A1 * | 11/2015 | Ng | H01R 13/646 439/607.28 |
| 2015/0340815 | A1 * | 11/2015 | Gao | H01R 13/6581 439/607.01 |
| 2016/0118752 | A1 * | 4/2016 | Guo | H01R 13/6585 439/78 |
| 2016/0197443 | A1 * | 7/2016 | Zhang | H01R 13/6585 439/607.05 |

* cited by examiner

RECEPTACLE CONNECTOR HAVING IMPROVED INSULATIVE HOUSING

BACKGROUND OF THE INVENTION

1. Field of the Invention

The present invention relates to a receptacle connector, and more sectionicularly to a receptacle connector having improved insulative housing.

2. Description of Related Art

The Universal Serial Bus and USB connectors are well known in the art.

China Patent No. 203871583 discloses a reverse receptacle connector. The receptacle connector includes an insulative housing, a number of contacts, a metal case engaged with the insulative housing, and a shielding shell enclosing the insulative housing. The insulative housing includes a first insulative base, a second insulative base, and a third insulative housing. The first insulative base and the second insulative base shape like cuboids. The third insulative housing defines a third insulative base and a tongue portion extending forwardly from the third base. The contacts include a number of first contacts retained in the first base and a number of second contacts retained in the second base. Each of the first contacts has a first contacting portion pendent from the first base and each of the second contacts has a second contacting portion pendent from the second base. However, the first insulative housing and the second insulative housing respectively resist the contacts and the metal case and the third insulative housing is over-molding with the first insulative housing and the second insulative housing to squeeze and deform the first insulative housing and the second insulative housing.

Hence, a new and simple receptacle connector is desired.

SUMMARY OF THE INVENTION

Accordingly, the object of the present invention is to provide a receptacle connector comprising: a first insulative housing having a first base portion and a first tongue portion extending forwardly from the base portion, the first tongue portion having a connection portion close to the base portion and a first stepping portion in a lower surface thereof; a second insulative housing having a second base portion and a second tongue portion extending forwardly from the second base portion, the second tongue portion having a second tongue portion in an upper surface thereof; a plurality of first contacts carried by the first insulative housing and second contacts carried by the second insulative housing, each first contact having a first contacting portion, a first affixed portion, and a first soldering portion, the connection portion, the first affixed portion, and the connecting section inclining in a same direction; a metallic shielding plate sandwiched by the first insulative housing and the second insulative housing, the metallic shielding plate having an opening to receive the first stepping portion and the second stepping portion to contact with each other therethrough; and a shielding shell attached to the first and second insulative housings.

Other objects, advantages and novel features of the invention will become more apparent from the following detailed description when taken in conjunction with the accompanying drawings.

DETAILED DESCRIPTION OF THE PREFERRED EMBODIMENT

Figure 1:
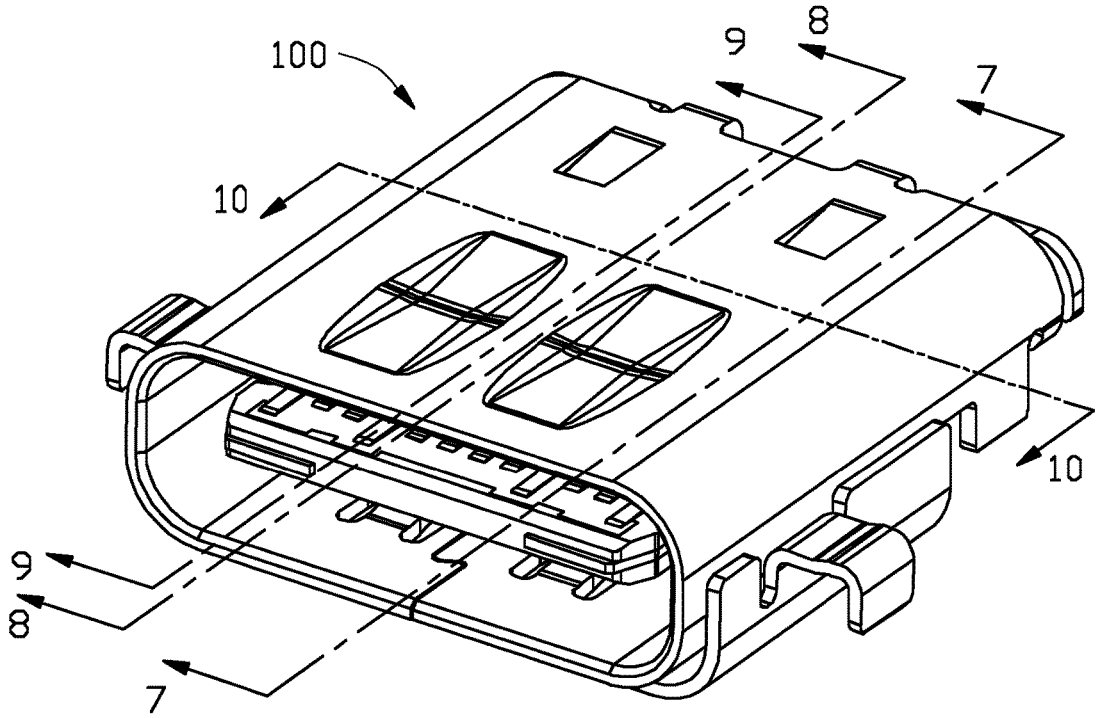
FIG. 1 is a perspective, assembled view of a receptacle connector.
Figure 2:
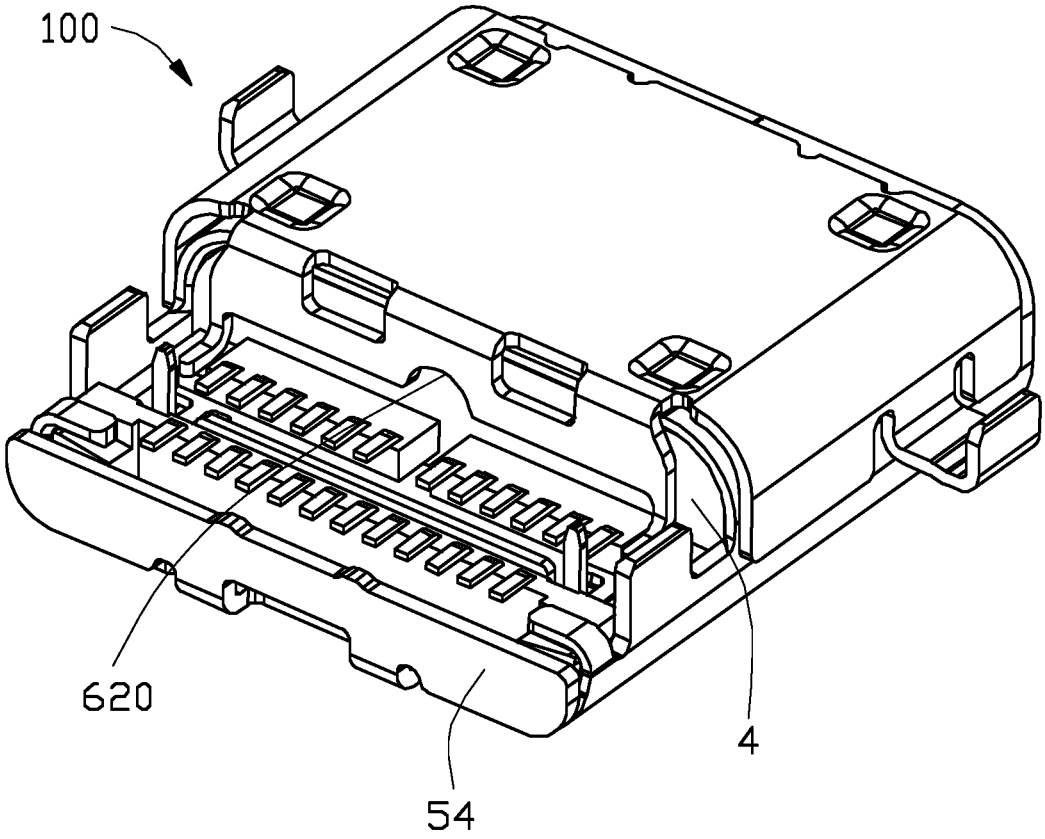
FIG. 2 is another perspective, assembled view of FIG. 1.
Figure 3:
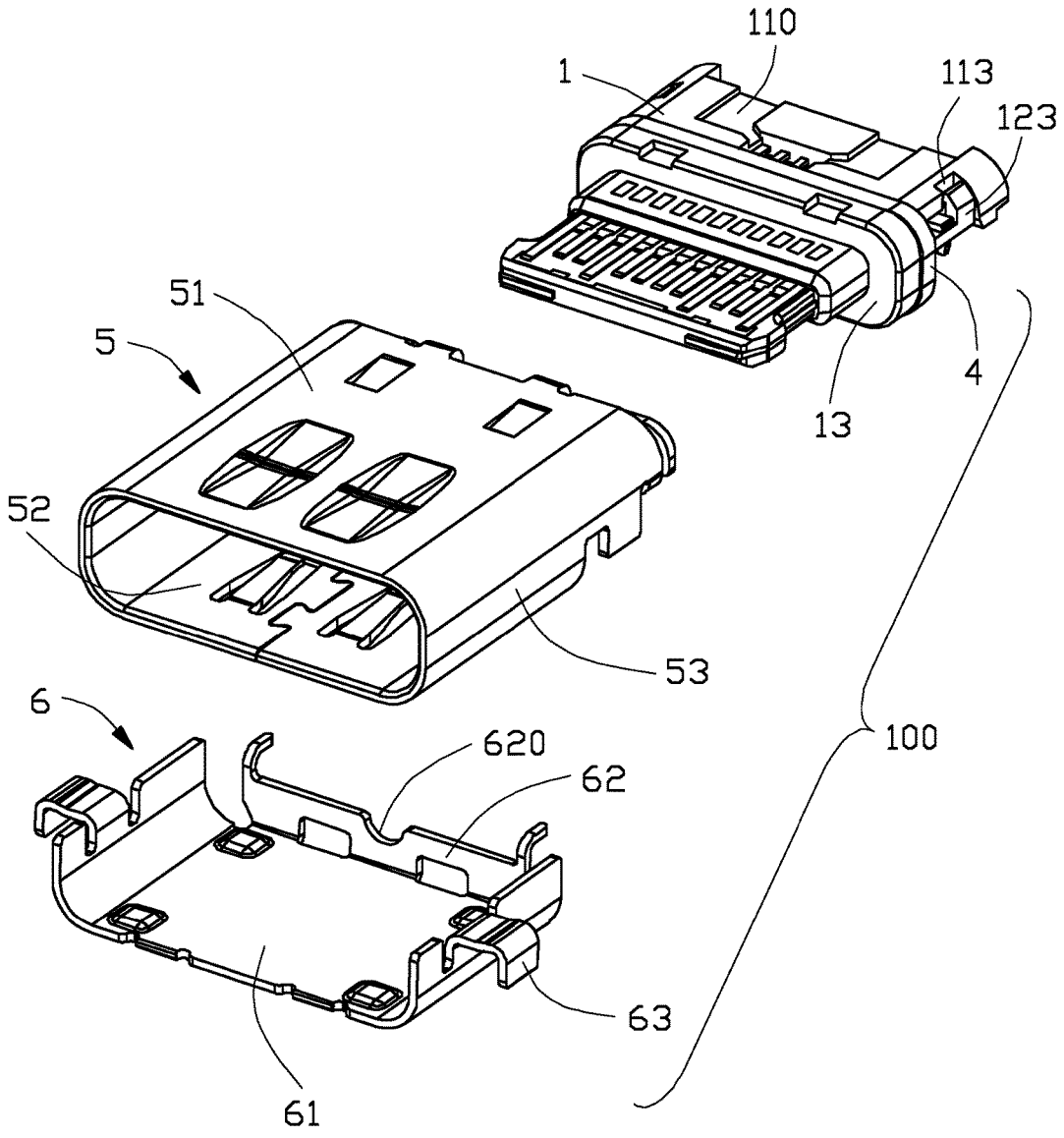
FIG. 3 is a perspective view of the receptacle connector separated with shielding shell and a metal shell.
Figure 4:
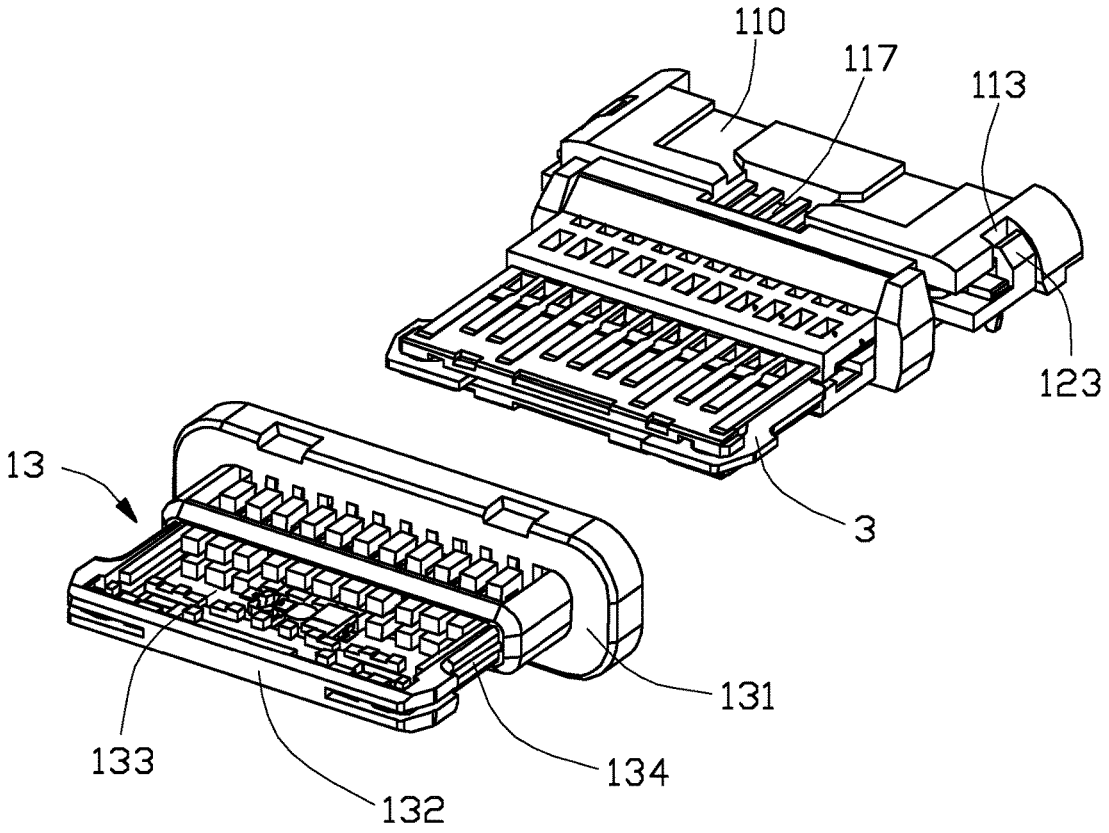
FIG. 4 is a perspective, partly exploded view of the receptacle connector with no shielding shell and no metal shell.

Reference will now be made in detail to the preferred embodiment of the present invention.

FIGS. 1-10 show a receptacle connector 100 mounted upon a printed circuit board 200 in a sink manner and cooperated with a plug connector. The receptacle connector 100 includes an insulative housing 1, a number of terminals 2 and a metallic shielding plate 3 retained in the insulative housing 1, a glue wall 4 sealing a back of the insulative housing 1, a shielding shell 5 formed with a mating cavity to receive the insulative housing 1, and a metal shell 6 attached to the shielding shell 5.

Referring to FIGS. 3-6, the insulative housing 1 includes a first insulative housing 11, a second insulative housing 12, and a third insulative housing 13. The first insulative housing 11 includes a first base portion 111 and a first tongue portion 112 extending forwardly from the first base portion 111. The first base portion 111 has a pair of depression 113 located at two sides thereof and a guiding hole 110 located at an upper surface thereof. The first tongue portion 112 has a connection portion 116 located close to the first base portion 111 and including at a lower surface thereof a first stepping portion 114 with a pair of first ribs 115 in two sides thereof. The first tongue portion 112 has a guiding gap 117 extending to the first base portion 111 and communicated with the guiding groove 110.

The second insulative housing 12 includes a second base portion 121 and a second tongue portion 122 extending forwardly from the second base portion 121. The second base portion 121 has a pair of projections 123 extending upwardly and locking the depressions 113 of the first insulative housing 11. The second tongue portion 122 has a connection portion (not labeled) with a second stepping portion 124 close to the second base portion 121 and located at an upper surface thereof. The second stepping portion 124 has a pair of second ribs 125 in two sides thereof. In this embodiment, the first stepping portion 114 and the second stepping portion 124 shape in right angles and respectively have a pair of flat surfaces. The flat surfaces include a step surface parallel to a horizontal plane. The step surface of the first stepping portion 114 is located at a lower surface of the first tongue portion 112, and the step surface of the second stepping portion 124 is located at an upper surface of the second tongue portion 122. The second base portion 121 includes a guiding hole 120 communicated with the guiding gap 117. Notably, in the first insulative housing 11, the first base portion 111 and the first tongue portion 112 are located at different levels so the corresponding connection portion 116 lies in an oblique plane, and so the second insulative housing is as well.

The third insulative housing 13 includes a third base portion 131 and a third tongue portion 132 extending forwardly from the third base portion 131. The third tongue portion 132 defines a hollow section 133 and receives the first tongue portion 112 and the second tongue portion 122. The third base portion 131 is abreast of an upper surface of the guiding groove 110 of the first insulative housing 1.

The terminals 2 include a number of first contacts 21 carried by the first tongue portion 112 and a number of second contacts 22 carried by the second tongue portion 122. The first contacts 21 and the second contacts 22 extend in an insertion direction and respectively include four power contacts located forwardly and eight signal contacts located backwardly. The two power contacts in the middle are used to provide electric source and the other two are used for electrical grounding. The eight signal contacts include four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Each of the first contacts 21 includes a first contacting portion 211 disposed in an upper surface of the first tongue portion 112, a first soldering portion 213 extending from a back end of the first base portion 111, and a first affixed portion 212 connected with the first contacting portion 211 and the first soldering portion 213. The affixed portion 212 extending inclining from the first contacting portion 211 and forms an obtuse angle therewith. Each of the second contacts 22 includes a second contacting portion 221 disposed in a bottom surface of the second tongue portion 122, a second soldering portion 222 extending from a back end of the second base portion 121, and a second affixed portion 222 connected with the second contacting portion 221 and the second soldering portion 223. The first contacts 21 and the second contacts 22 are positioned e to have 180 degree symmetry such that the corresponding plug connector can be inserted and operatively coupled to the receptacle connector 100 in either of two orientations. The first soldering portions 212 and the second soldering portions 222 are located at a same plane and configured in two rows.

Figure 5:
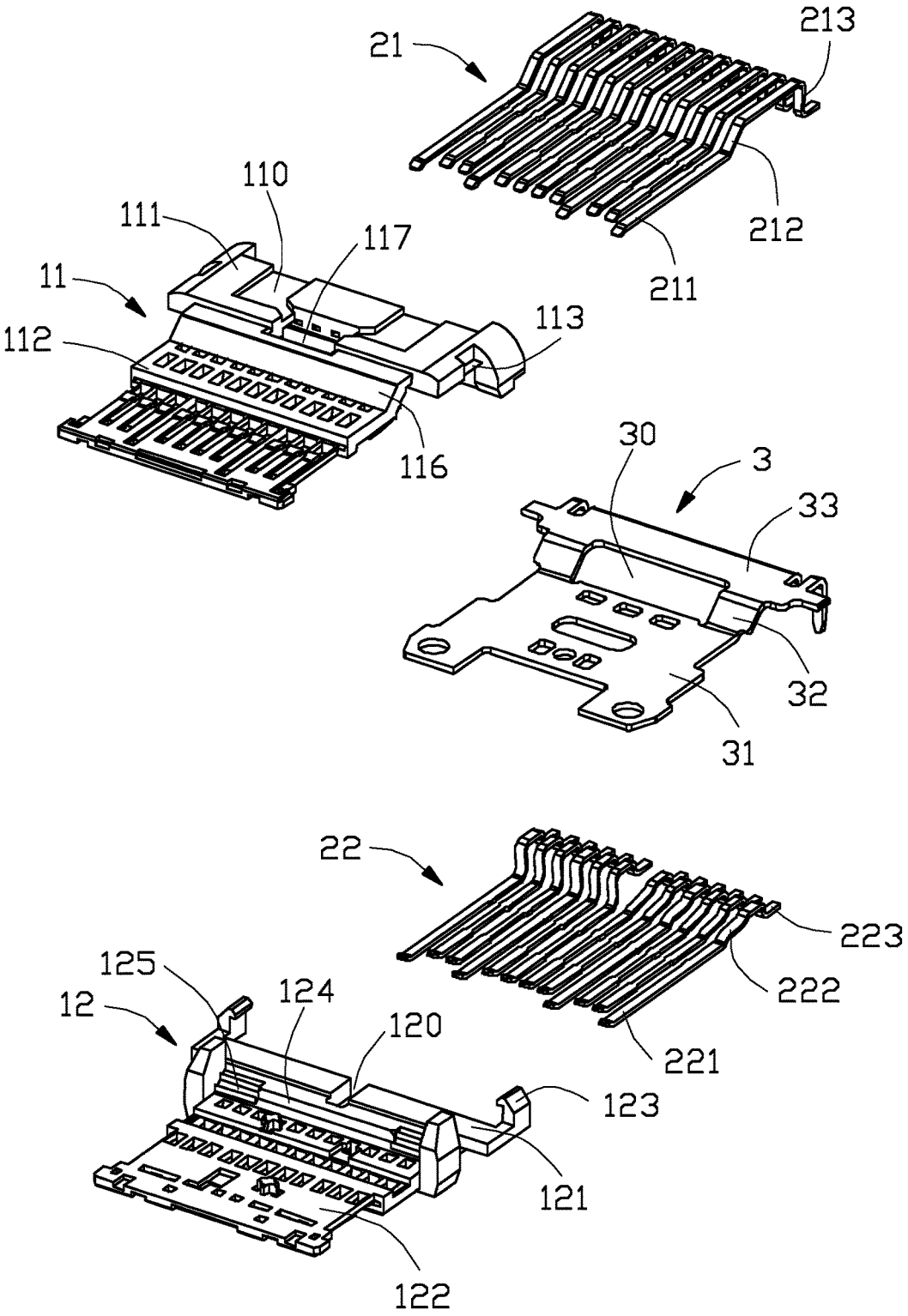
FIG. 5 is a partly exploded view of the receptacle connector of FIG. 4 with no third insulative housing.
Figure 6:
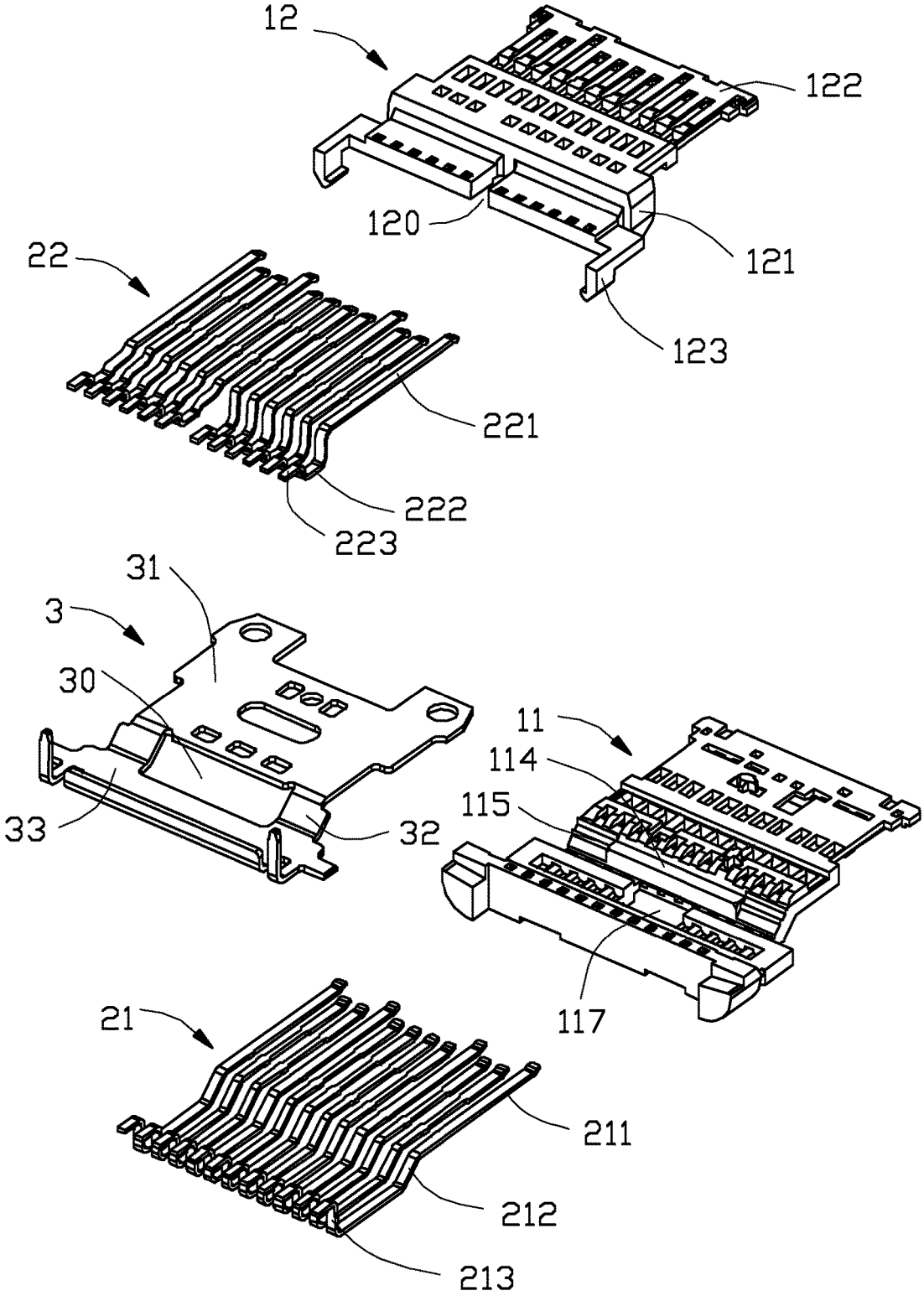
FIG. 6 is another partly exploded view of FIG. 5.

Referring to FIGS. 5-6, the metallic shielding plate 3, shaping like a panel, includes a supporting section 31, a connecting section 32 extending inclining from the supporting section 31, and a panel section 33 extending backwardly from the connecting section 32. The supporting section 31 is exposed from the receiving section 134 of the insulative housing 1. The connection portion 116, the first affixed portion 212, and the connecting section 32 incline in a same direction. The connecting section 32 has an opening 30 receiving the first stepping portion 114 and the second stepping portion 124. The step surface of the first stepping portion 114 contacts with the step surface of the second stepping portion 124 through the opening 30. The first ribs 115 has an aperture or escaping space with the second ribs 125 to avoid over cemented in insert-molded process of the third insulative housing 13.

The shielding shell 5 includes a top wall 51 and a bottom wall 52 located oppositely, a pair of side walls 53 connected with the top wall 51 and the bottom wall 52, and a rear wall 54 separated with the bottom wall 52.

The metal shell 6 includes a main section 61, a back plate 62 extending downwardly from a rear end of the main board 61, and a pair of affixed legs 63. The rear board 62 shields after the glue wall 4 and has a aperture 620 to increase dimension in flowing glue.

Figure 7:
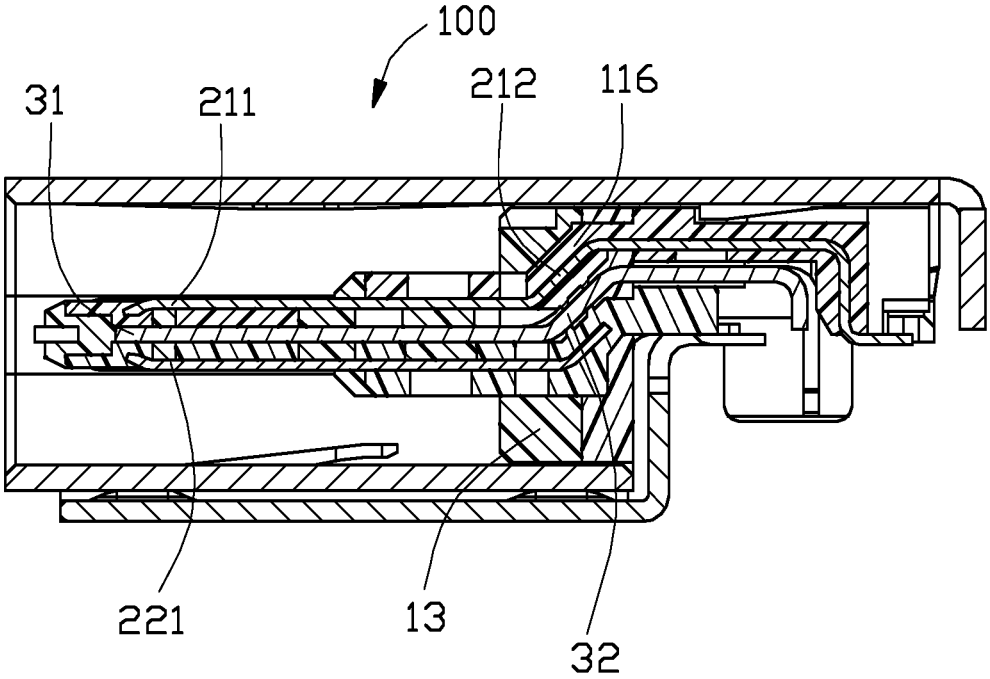
FIG. 7 is a cross-sectional view of the electrical connector along line 7-7 in FIG. 1.
Figure 8:
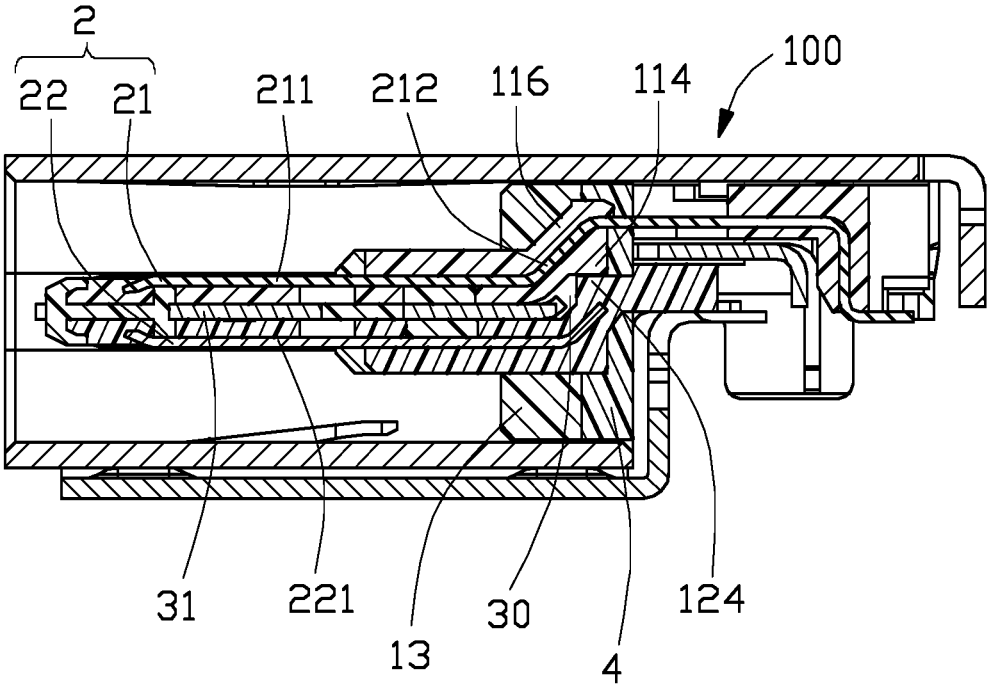
FIG. 8 is a cross-sectional view of the electrical connector along line 8-8 in FIG. 1.
Figure 9:
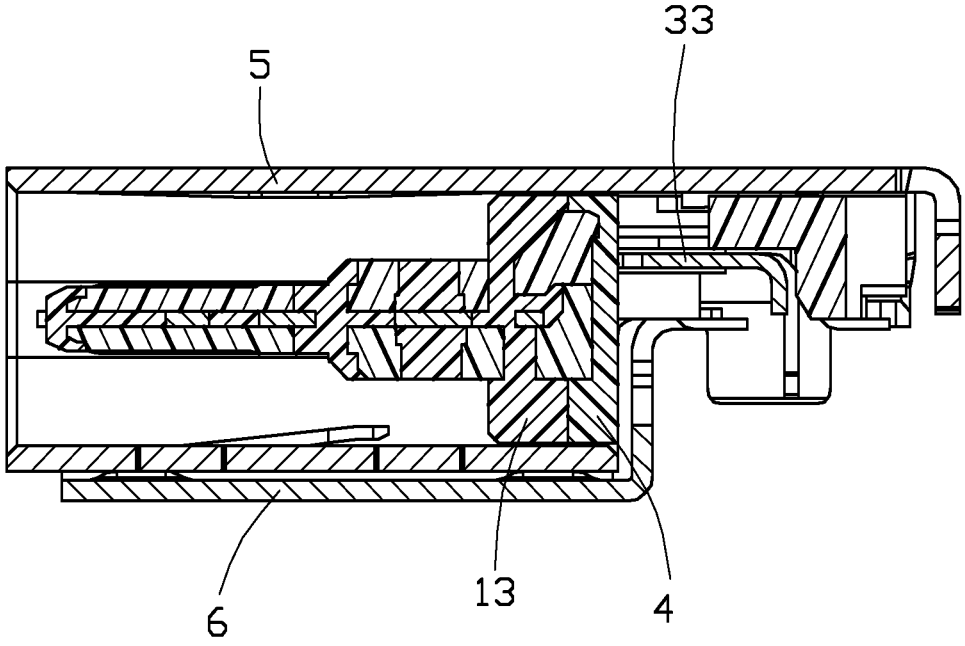
FIG. 9 is a cross-sectional view of the electrical connector along line 9-9 in FIG. 1.
Figure 10:
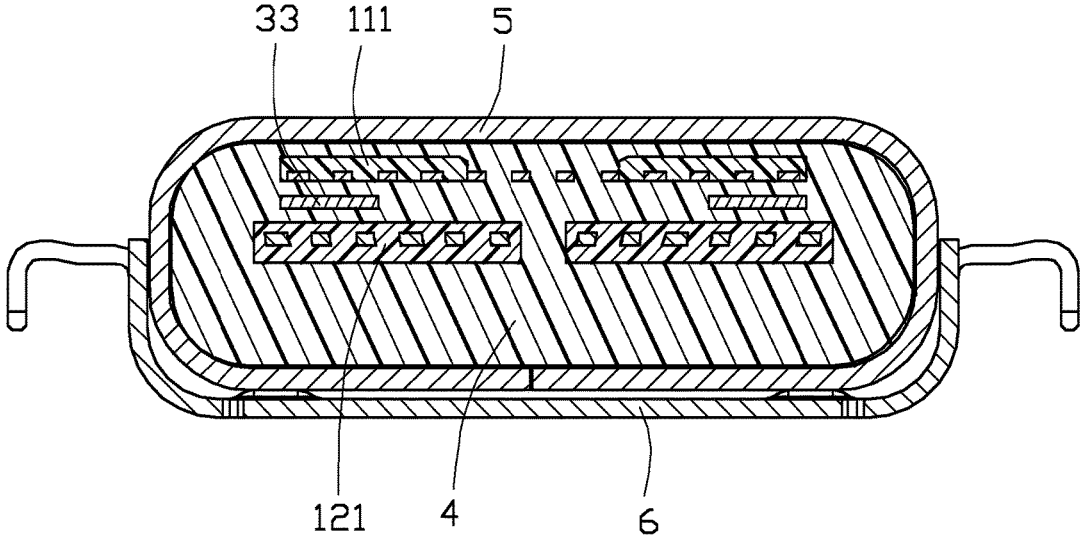
FIG. 10 is a cross-sectional view of the electrical connector along line 10-10 in FIG. 1.

Referring to FIGS. 7-8, the first insulative housing 11 with the first contacts 21 and the second insulative housing 12 with the second contacts are respectively insert-molded, then assembled with the metallic shielding plate 3. The third insulative housing 13 is over-molded with the first insulative housing 11, the metallic shielding plate 3, and the second insulative housing 12 to orient the terminals 2 in a right way. The step surface of the first stepping portion 114 contacts with the step surface of the second stepping portion 124 through the opening 30.

However, the disclosure is illustrative only, changes may be made in detail, especially in matter of shape, size, and arrangement of sections within the principles of the invention.

What is claimed is:

1. A receptacle connector comprising:

a first insulative housing having a first base portion and a first tongue portion extending forwardly from the first base portion, the first tongue portion having a connection portion close to the base portion with a first stepping portion in a lower surface thereof;

a second insulative housing having a second base portion and a second tongue portion extending forwardly from the second base portion, the second tongue portion having a second stepping portion in an upper surface thereof;

a plurality of first contacts carried by the first insulative housing, each first contact having a first contacting portion, a first affixed portion, and a first soldering portion;

a plurality of second contacts carried by the second insulative housing;

a metallic shielding plate sandwiched between the first insulative housing and the second insulative housing, the metallic shielding plate having a connecting section inclining with the connection portion and the first affixed portion in a same direction and an opening receiving the first stepping portion and the second stepping portion, the first stepping portion and the second stepping portion contacting with each other through the opening; and a shielding shell attached to the first and second insulative housings.

2. The receptacle connector as claimed in claim 1, wherein said first stepping portion and the second stepping portion respectively have a step surface, and the step surface of the first stepping portion is located at a lower surface of the first tongue portion and resisted against by the step surface of the second stepping portion located at an upper surface of the second tongue portion.

3. The receptacle connector as claimed in claim 2, wherein said first stepping portion and the second stepping portion shape in right angles and respectively have a pair of flat surfaces, the step surface is located at the flat surface, and the flat surface has a vertical surface perpendicular to the step surface.

4. The receptacle connector as claimed in claim 1, wherein said first affixed portions of the first contacts are received in a lower surface of the connection portion, and the first stepping portion is located at a lower surface of the connection portion.

5. The receptacle connector as claimed in claim 1, wherein said first stepping portion protrudes downwardly to the opening and the second stepping portion protrudes upwardly to the opening.

6. The receptacle connector as claimed in claim 5, wherein said first stepping portion has a pair of ribs located at two sides thereof, the second stepping portion has a pair of ribs located at two sides thereof, and first stepping portion and the second stepping portion have an aperture therebetween to flow glue.

7. An electrical connector comprising:

a first insulative housing having a front first tongue portion and a rear first base portion in a front-to-back direction, said first base portion being higher than the first tongue portion in a vertical direction perpendicular to said front-to-back direction, and connected with each other via an obliquely extending first connection portion therebetween in said front-to-back direction, a first step structure formed on the first connection portion;

a second insulative housing having a front second tongue portion and a rear second base portion in the front-to-back direction, said second base portion being higher than the second tongue portion connected with each other via another obliquely extending second connection portion therebetween in the front-to-back direction, a second step structure formed on the first connection portion;

a metallic grounding plate sandwiched between said first insulative housing and said second insulative housing in and including a supporting section and a panel section with an obliquely extending connection section therebetween in the front-to-back direction, wherein said supporting section is sandwiched between the first tongue portion and the second tongue portion in the vertical direction to form a sub-assembly, said panel is sandwiched between the first base portion and the second base portion in the vertical direction, and said connection section is sandwiched between the first connection portion and the second connection portion in an oblique direction; wherein said grounding plate forms an opening through which the first step structure and the second step structure are coupled with each other intimately to resist imposed force along the vertical direction.

8. The electrical connector as claimed in claim 7, wherein an escaping space is formed between the first connection portion and the second connection portion beside the coupled first step structure and second step structure so as to receive therein redundant material of a third insulative housing which is overmolded upon said sub-assembly.

9. The electrical connector as claimed in claim 7, further including a plurality of first contacts insert-molded within the first insulative housing, and a plurality of second contacts insert-molded within the second insulative housing.

10. The electrical connector as claimed in claim 7, wherein each of said first base portion and said second base portion further include a guiding hole communicating with each other in the vertical direction, and at least one of said guiding holes communicates with an exterior for injection of glue to form a glue wall for waterproof.

11. The electrical connector as claimed in claim 10, wherein a third insulative housing is overmolded upon the sub-assembly to form a housing assembly, and a metallic shell encloses the housing assembly, and said glue wall fills space behind the third insulative housing and the first connection portion and the second connection portion in said shell.

12. The electrical connector as claimed in claim 11, wherein the first base portion and the second base portion extend through said glue wall rearwardly.

13. The electrical connector as claimed in claim 12, wherein said grounding plate extends through said glue wall rearwardly.

14. The electrical connector as claimed in claim 7, wherein said first step structure includes at least one horizontal first plane and said second step structure includes at least one horizontal second plane abutting against the first plane in the vertical direction.

* * * * *